US007007770B2

(12) United States Patent
Perez

(10) Patent No.: US 7,007,770 B2
(45) Date of Patent: Mar. 7, 2006

(54) APPARATUS CONVERTIBLE BETWEEN CREEPER AND STEPLADDER CONFIGURATIONS

(76) Inventor: Genaro Perez, P.O. Box 2049, Placerville, CA (US) 95667

( * ) Notice: Subject to any disclaimer, the term of this patent is extended or adjusted under 35 U.S.C. 154(b) by 28 days.

(21) Appl. No.: 10/706,020

(22) Filed: Nov. 12, 2003

(65) Prior Publication Data

US 2005/0098382 A1 May 12, 2005

(51) Int. Cl.
*E06C 1/00* (2006.01)

(52) U.S. Cl. ..... 182/21; 280/32.6

(58) Field of Classification Search ..... 182/20, 182/21, 163; 403/94; 280/32.6
See application file for complete search history.

(56) References Cited

U.S. PATENT DOCUMENTS

| | | | | |
|---|---|---|---|---|
| 2,611,417 A | | 9/1952 | Henry et al. | |
| 4,889,352 A | | 12/1989 | Chamberlin, Jr. et al. | |
| 5,072,955 A | | 12/1991 | Holland et al. | |
| 5,395,154 A | * | 3/1995 | Wang | 297/130 |
| 5,494,305 A | * | 2/1996 | Chen | 280/32.6 |
| 5,524,915 A | * | 6/1996 | Liu | 280/30 |
| 5,947,489 A | | 9/1999 | Tucker | |
| 6,059,298 A | | 5/2000 | Tucker | |
| 6,095,532 A | | 8/2000 | Martin | |
| 6,105,719 A | | 8/2000 | Lensing | |
| 2002/0125662 A1 | | 9/2002 | Magness | |
| 2003/0132589 A1 | * | 7/2003 | Hernandez et al. | 280/32.6 |

* cited by examiner

*Primary Examiner*—Alvin Chin-Shue
(74) *Attorney, Agent, or Firm*—Thomas R. Lampe

(57) ABSTRACT

Apparatus for supporting an individual is employable as either a creeper or a stepladder and includes two hingedly connected platform portions which can be locked in co-planar condition or in a configuration where the platform portions define an angle therebetween of less than 180 degrees.

6 Claims, 2 Drawing Sheets

APPARATUS CONVERTIBLE BETWEEN CREEPER AND STEPLADDER CONFIGURATIONS

TECHNICAL FIELD

This invention relates to apparatus for supporting an individual and selectively alternatively employable as either a creeper or as a stepladder.

BACKGROUND OF THE INVENTION

Stepladders and creepers are well known devices. Conventionally, these devices are separate entities and are employed separately. This of course requires separate purchases. Furthermore, each device occupies its own storage space.

As will be seen below, the apparatus of the present invention incorporates platform portions hingedly interconnected to provide either a stepladder configuration or a creeper configuration. A search of the prior art located no such arrangement. There are, however, patents which show the general concept of folding creepers per se; namely, U.S. Pat. No. 6,095,532, issued Aug. 1, 2000, U.S. Pat. No. 5,947,489, issued Sep. 7, 1999, U.S. Pat. No. 6,059,298, issued May 9, 2000, U.S. Pat. No. 4,889,352, issued Dec. 26, 1989, and U.S. Pat. No. 2,611,417, issued Sep. 23, 1952.

The search also located U.S. Pat. No. 5,072,955, issued Dec. 7, 1991, relating to a mechanic's helper (not a creeper) and step platform, U.S. Pat. No. 6,105,719, issued Aug. 22, 2000, directed to a user-configurable mechanic's stool, and U.S. Patent Application Publication No. US2002/0125662, published Sep. 12, 2002. Articulated ladders enabling the ladders to fold and assume different configurations are also known; however, such prior art articulated ladders are not convertible into creepers.

In summary, there is no teaching or suggestion in the prior art, whether taken alone or in combination, of the apparatus disclosed and claimed herein for supporting an individual and selectively alternatively employable as either a creeper or a stepladder.

DISCLOSURE OF INVENTION

The present invention relates to apparatus of unitary construction for supporting an individual and selectively alternatively employable as either a creeper or a stepladder. The apparatus incorporates a platform including a generally planar first platform portion and a generally planar second platform portion, each of the first and second platform portions having a top surface and a bottom surface and proximal and distal ends.

At least one hinge hingedly connects the proximal end of the first platform portion to the proximal end of the second platform portion. The first and second platform portions are selectively movable relative to one another about the at least one hinge to form either a creeper configuration wherein the first and second platform portions are substantially co-planar or a stepladder configuration wherein the first and second platform portions define an angle therebetween of less than 180 degrees and more than zero degrees.

The apparatus also includes wheels projecting downwardly from the bottom surfaces of the first and second platform portions for supporting the apparatus when the first and second platform portions are in the creeper configuration. At least one of the first and second platform portions defines foot holes for receiving the feet of an individual climbing the apparatus when the first and second platform portions are in the stepladder configuration.

Other features, advantages and objects of the present invention will become apparent with reference to the following description and accompanying drawings.

BEST MODE FOR CARRYING OUT THE INVENTION

Figure 1:
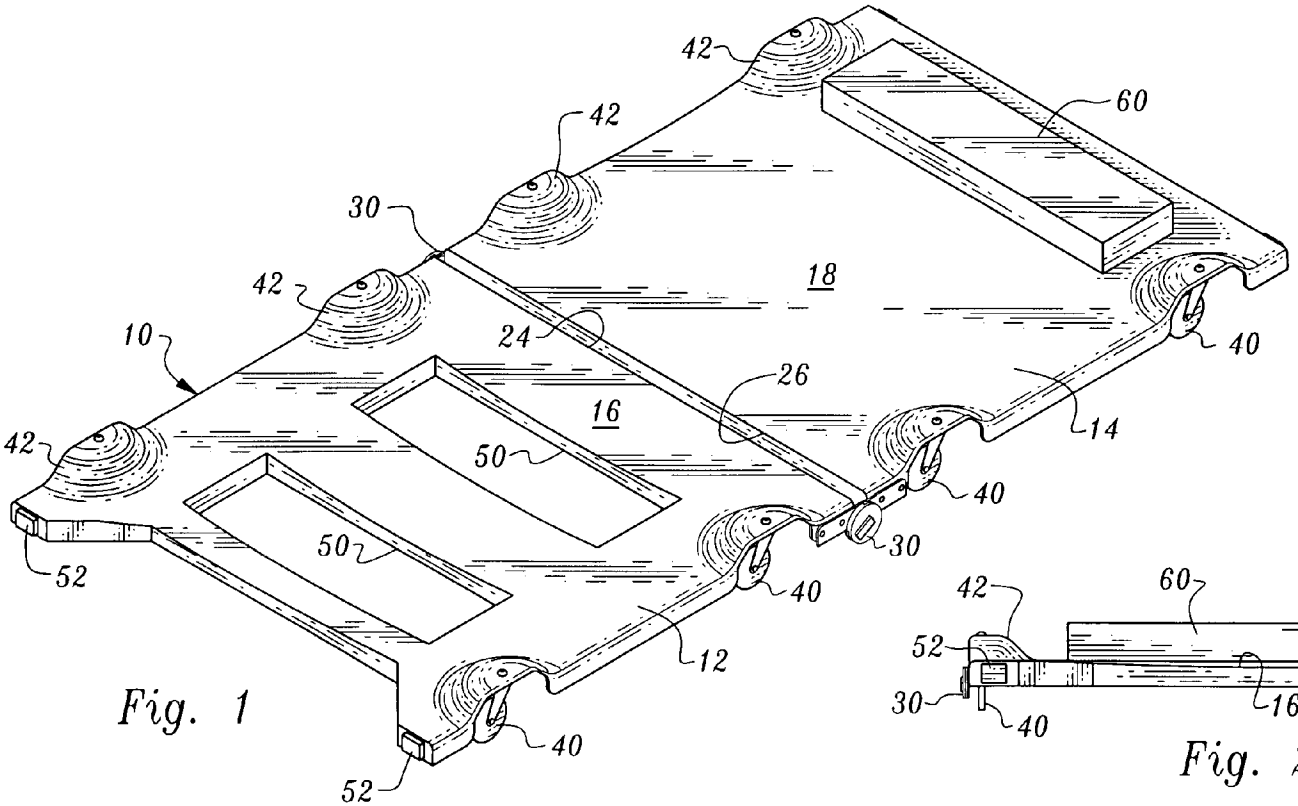
FIG. 1 is a top, perspective view of the apparatus of the present invention configured as a creeper.

Referring now to the drawings, apparatus constructed in accordance with the teachings of the present invention is illustrated and is for the purpose of supporting an individual and selectively alternatively employable as either a creeper (also known as a mechanic's creeper) or a stepladder.

The apparatus includes a platform 10 including a generally planar platform portion 12 and a generally planar platform portion 14. Platform portion 12 has a top surface 16 and platform portion 14 has a top surface 18. Platform portion 12 has a bottom surface 20 and platform portion 14 has a bottom surface 22. The platform portions may be formed of any suitable material, for example molded plastic or metal. The top surfaces 16, 18 are slightly concaved or dipped to provide comfort for an individual lying on the apparatus when in its creeper configuration, as will be described in more detail below. In the arrangement shown, the concavity of top surface 16 is slightly less than the concavity of top surface 18.

The proximal ends 24, 26 of the platform portions 12, 14, respectively, are hingedly connected by hinges 30 of identical construction. Hinges 30 are in the nature of locking hinges enabling the first and second platform portions to be releasably locked against relative movement when either in a stepladder configuration or in a creeper configuration. Any type of known commercially available locking hinge may be employed for such purpose, for example the Multi-Lok hinge made available by Warner Co. of Greenville, Pa.

Figure 2:
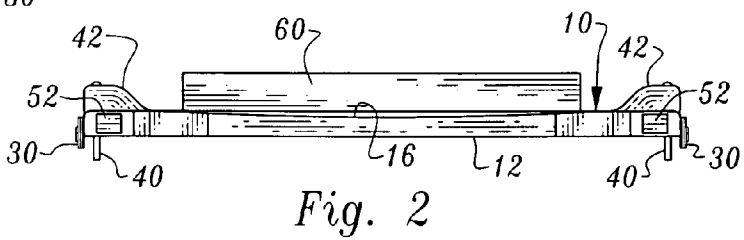
FIG. 2 is an end, elevational view of the apparatus in the creeper configuration.
Figure 3:
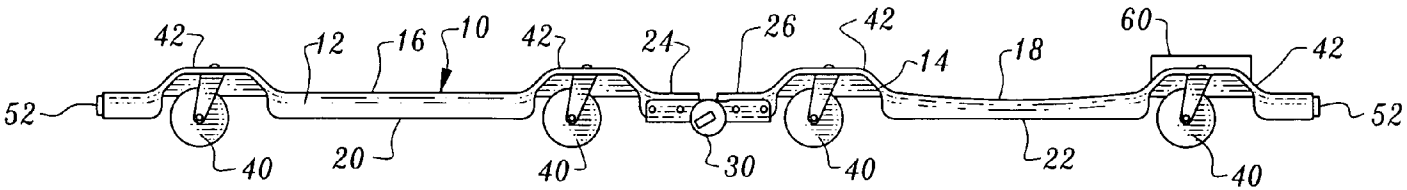
FIG. 3 is a side, elevational view of the apparatus when in the creeper configuration.
Figure 4:
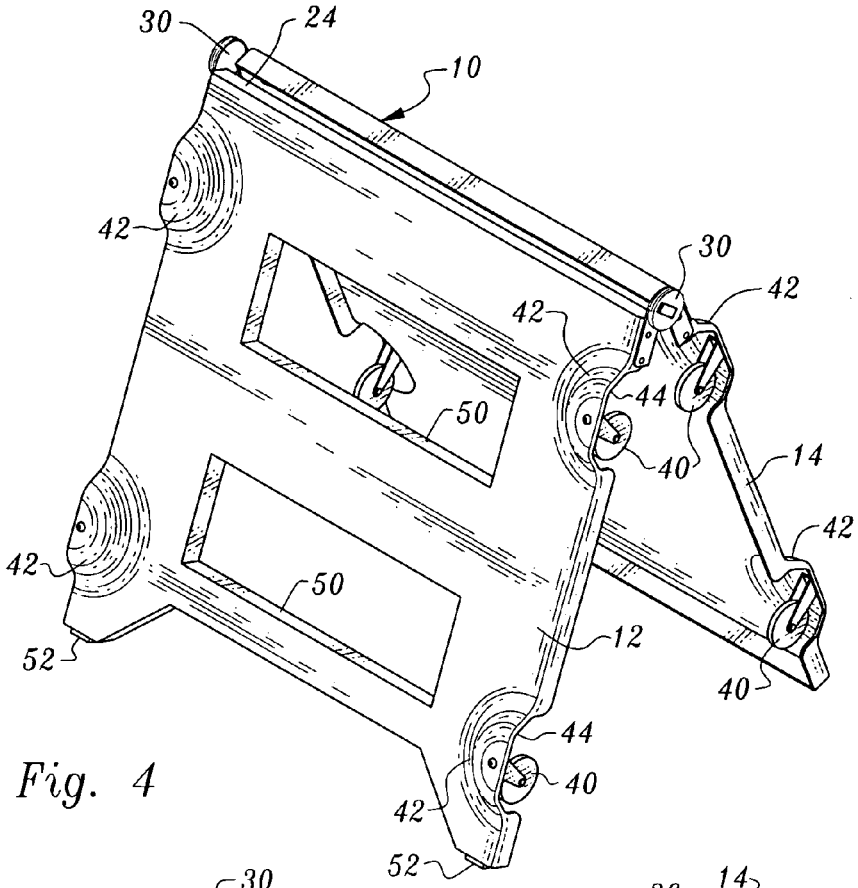
FIG. 4 is a perspective view of the apparatus configured as a stepladder.
Figure 5:
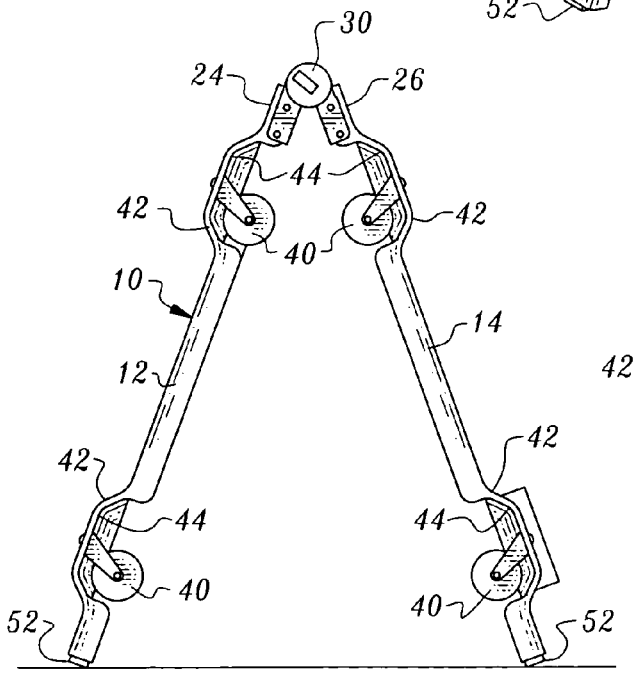
FIG. 5 is a side, elevational view of the apparatus configured as a stepladder.
Figure 6:
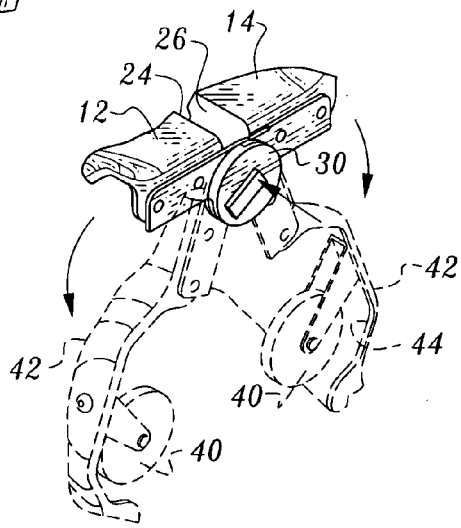
FIG. 6 is a perspective view illustrating selected structure, including a hinge employed to hingedly connect proximal ends of two platform portions of the apparatus together, the solid lines depicting the hinge and associated distal ends of the platform portions when the apparatus is in a creeper configuration and the broken lines showing the illustrated components when the apparatus is in a stepladder configuration.

The platform portions are selectively movable relative to each other about the spaced hinges 30 to form either a creeper configuration (shown in FIGS. 1–3) wherein the platform portions 12, 14 are substantially co-planar or a stepladder configuration (shown in FIGS. 4 and 5) wherein the platform portions define an angle therebetween of less than 180 degrees and more than zero degrees. FIG. 6 shows in solid and broken lines the two alternative positions of the proximal ends of the platform portions and associated structure when the apparatus is respectively in the creeper configuration and in the stepladder configuration. Arrows in FIG. 6 illustrate movement that occurs when converting to the stepladder configuration to the creeper configuration following depression of a release button on the hinge.

Casters including caster wheels 40 project downwardly from the bottom surfaces of the platform portions for supporting the apparatus when the platform portions are in the creeper configuration. In the arrangement illustrated, there are four caster wheels 40 projecting downwardly from each platform portion to provide stability.

The platform portions 12, 14 include a plurality of upwardly projecting fenders 42 defining fender interiors accommodating portions of the caster wheels 40. The fenders further define side fender openings 44 which provide clearance for the casters to swing freely and also to provide access to the casters for replacement, repair, etc. In the arrangement illustrated, the casters are pivotally connected to the tops of the fenders by threaded connectors projecting through the fender tops.

The platform portion 12 defines elongated rectangular shaped foot holes 50 for receiving feet of an individual (not shown) climbing the apparatus when the platform portions are in the stepladder configuration.

Support surface engagement projections such as rubber pegs 52 project from the distal ends of the platform portions for engaging a floor or other support surface to support the apparatus when the platform portions are in the stepladder configuration to resist slippage of the apparatus on the support surface. A headrest 60 projects upwardly from platform portion 14 to add to the comfort of the user.

The invention claimed is:

1. Apparatus for supporting an individual and selectively alternatively employable as either a creeper or a stepladder, said apparatus comprising, in combination:

a platform including a generally planar first platform portion and a generally planar second platform portion, each of said first and second platform portions having a top surface and a bottom surface and proximal and distal ends;

at least one locking hinge hingedly connecting the proximal end of said first platform portion to the proximal end of said second platform portion, with said first and second platform portions being selectively movable relative to each other about said at least one locking hinge to form either a creeper configuration wherein said first and second platform portions are substantially co-planar or a stepladder configuration wherein said first and second platform portions define an angle therebetween of less than 180 degrees and more than 0 degrees and said apparatus is supported by and extending upwardly from the spaced distal ends of said angularly disposed first platform portion and said second platform portion, said at least one locking hinge cooperable with said first platform portion and said second platform portion to selectively alternatively lock said first platform portion and said second platform portion against relative movement both when said first platform portion and said second platform portion are in said creeper configuration or in said stepladder configuration; and wheels projecting downwardly from the bottom surfaces of said first and second platform portions for supporting said apparatus when said first and second platform portions are in said creeper configuration, and at least one of said first and second platform portions defining foot holes completely extending therethrough for receiving feet of an individual climbing the apparatus when said first and second platform portions are locked by said at least one locking hinge in said stepladder configuration.

2. The apparatus according to claim 1 wherein two locking hinges spaced from one another connect the proximal end of said first platform portion to the proximal end of said second platform portion.

3. The apparatus according to claim 1 wherein said foot holes have an elongated, rectangular configuration.

4. The apparatus according to claim 1 wherein said wheels comprise caster wheels, at least four caster wheels projecting downwardly from the bottom surfaces of each of said first and second platform portions, wherein each of said first and second platform portions includes a plurality of upwardly projecting fenders defining fender interiors accommodating portions of said caster wheels, a pivotal interconnection existing between said caster wheels and fenders, and wherein said fenders define side fender openings communicating with the fender interiors.

5. The apparatus according to claim 1 additionally comprising support surface engagement projections projecting from the distal ends of said first and second platform portions, said support surface engagement projections for engaging a floor or other support surface to support the apparatus when said first and second platform portions are in said stepladder configuration to resist slippage of the apparatus on the support surface.

6. The apparatus according to claim 1 wherein the top surfaces of said first platform portion and said second platform portion face outwardly and away from each other and wherein the bottom surfaces of said first platform portion and said second platform portion face inwardly and toward each other when said first platform portion and said second platform portion are in said stepladder configuration.

* * * * *